US006681780B1

(12) United States Patent
Baxter

(10) Patent No.: US 6,681,780 B1
(45) Date of Patent: Jan. 27, 2004

(54) DUAL COMPARTMENT COMPACT WITH MIRROR

(76) Inventor: Alma J. Baxter, 17355-35th PL-North, Loxahatchee, FL (US) 33470

( * ) Notice: Subject to any disclaimer, the term of this patent is extended or adjusted under 35 U.S.C. 154(b) by 0 days.

(21) Appl. No.: 10/128,026

(22) Filed: Apr. 22, 2002

(51) Int. Cl.[7] ..... A45D 33/22
(52) U.S. Cl. ..... 132/295; 132/301
(58) Field of Search ..... 132/295, 296, 132/297, 300, 301, 286; D28/76, 77, 78, 79, 83; 206/581, 235, 542, 233, 544, 543; 220/503, 521

(56) References Cited

U.S. PATENT DOCUMENTS

| | | | | | |
|---|---|---|---|---|---|
| 1,455,647 | A | * | 5/1923 | Morrison | 132/297 |
| 1,456,636 | A | * | 5/1923 | Kendall | 132/297 |
| 1,527,052 | A | * | 2/1925 | Mc Andrews | 132/297 |
| 1,686,200 | A | * | 10/1928 | Cannard et al. | 206/233 |
| 2,121,221 | A | | 6/1938 | Fontan | |
| 2,796,874 | A | * | 6/1957 | Steiner | 132/297 |
| 2,823,681 | A | * | 2/1958 | Miller | 132/297 |
| 3,054,501 | A | * | 9/1962 | Maynard | 206/544 |
| 4,326,546 | A | | 4/1982 | Acker | |
| 5,156,275 | A | | 10/1992 | Murray, Sr. | |
| 5,178,478 | A | | 1/1993 | Ryder | |
| D354,374 | S | * | 1/1995 | Battaglia | D28/77 |
| 5,441,153 | A | | 8/1995 | Lahaye | |
| 5,860,755 | A | | 1/1999 | Bunk | |
| 5,983,905 | A | | 11/1999 | Patching | |
| 6,138,688 | A | | 10/2000 | Lombardi, Jr. | |
| 6,164,442 | A | * | 12/2000 | Stravitz | 206/233 |
| 6,321,925 | B1 | * | 11/2001 | Crouse et al. | 220/521 |

* cited by examiner

*Primary Examiner*—Todd E. Manahan
(74) *Attorney, Agent, or Firm*—John D. Gugliotta; Olen L. York, III

(57) ABSTRACT

A dual compartment compact with mirrors is a small, dual compartment storage container. The compartments are stacked one upon the other, producing a rectangular shaped box that is approximately three inches long, one inch deep and an inch and a half high. The lower compartment holds a tube of lipstick, while the upper compartment holds a small package of tissues or pre-moistened towelettes. Mirrors are also provided in the lids of the upper and lower storage compartments to allow the user to see their lips while the lipstick is applied or removed.

7 Claims, 5 Drawing Sheets

DUAL COMPARTMENT COMPACT WITH MIRROR

RELATED APPLICATIONS

The present invention was first described in Disclosure Document Registration 501,524 filed on Oct. 25, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to cosmetic storage and dispensing devices and, more particularly, to a storage and dispensing design for accommodating a combination of lipstick, tissues and mirror.

2. Description of the Related Art

The industries relating to personal style and fashion are constantly growing and evolving. People are continually striving to create and maintain their personal look, style and identity while keeping in tune with the latest trends as they hit the fashion scene. Among the many facets of which these multimillion dollar trades are comprised, the field of health and beauty care, and particularly that of makeup is perhaps the largest and most highly regarded.

A search of the prior art did not disclose any patents that read directly on the claims of the instant invention; however, the following references were considered related.

U.S. Pat. No. 6,138,688 issued in the name of Lombardi Jr., describes a unitary assembly that clusters a mirror, lipstick, and cosmetic pencil.

U.S. Pat. No. 5,983,905, issued in the name of Patching, describes a lipstick container with flip-up mirror.

U.S. Pat. No. 5,860,755 issued in the name of Bunk, describes a lipstick holder with mirror including a cylindrical housing member.

U.S. Pat. No. 5,441,153 issued in the name of Lahaye, describes a new lipstick case for containing a plurality of lipstick.

U.S. Pat. No. 5,178,478 issued in the name of Ryder, a case for holding a lipstick in combination with a lip brush, clip for top of lipstick, and mirror.

U.S. Pat. No. 5,156,275 issued in the name of Murray Sr., describes a cosmetic bottle consisting of a set of rectangularly configured compartments.

U.S. Pat. No. 4,326,546 issued in the name of Acker, describes a container or holder for lipstick mounted in front of a mirror.

U.S. Pat. No. 2,121221 issued in the name of Fontan, describes an improved lipstick receptacle with mirror.

Consequently, there exists a continuous need for new product ideas and enhancements for existing products in the makeup industry.

SUMMARY OF THE INVENTION

It is therefore an object of the present invention to provide an improved cosmetic storage and dispensing devices.

It is a feature of the present invention to provide an improved storage and dispensing design for accommodating a combination of lipstick, tissues and mirror.

Briefly described according to one embodiment of the present invention, a dual compartment compact with mirror is a small, dual compartment storage container. The compartments are stacked one upon the other, producing a rectangular shaped box that is approximately three inches long, one inch deep and an inch and a half high. The lower compartment holds a tube of lipstick, while the upper compartment holds a small package of tissues or pre-moistened towelettes. Mirrors are also provided in the lids of the upper and lower storage compartments. The upper compartment allows the user to see their lips while removing previous lipsticks. The lower compartment allows the user to see their lips while the lipstick is applied. Additionally, a small strap can also be provided to attach the invention to the inside of a purse to ensure that the invention is not lost and to make it easy to find within the purse The use of the present invention provides users with all of the materials and tools necessary to ensure that their lipstick is at its best appearance in a small, convenient package that is easy to access and carry.

An advantage of the present invention is that it is specifically adapted for storage and dispensing a combination of lipstick, tissues and mirror.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 2 is a cross-sectional view of the apparatus shown in. FIG. 1 taken through line 1—1 and with the invention viewed from the right side.

DESCRIPTION OF THE PREFERRED EMBODIMENTS

1. Detailed Description of the Figures

Figure 1:
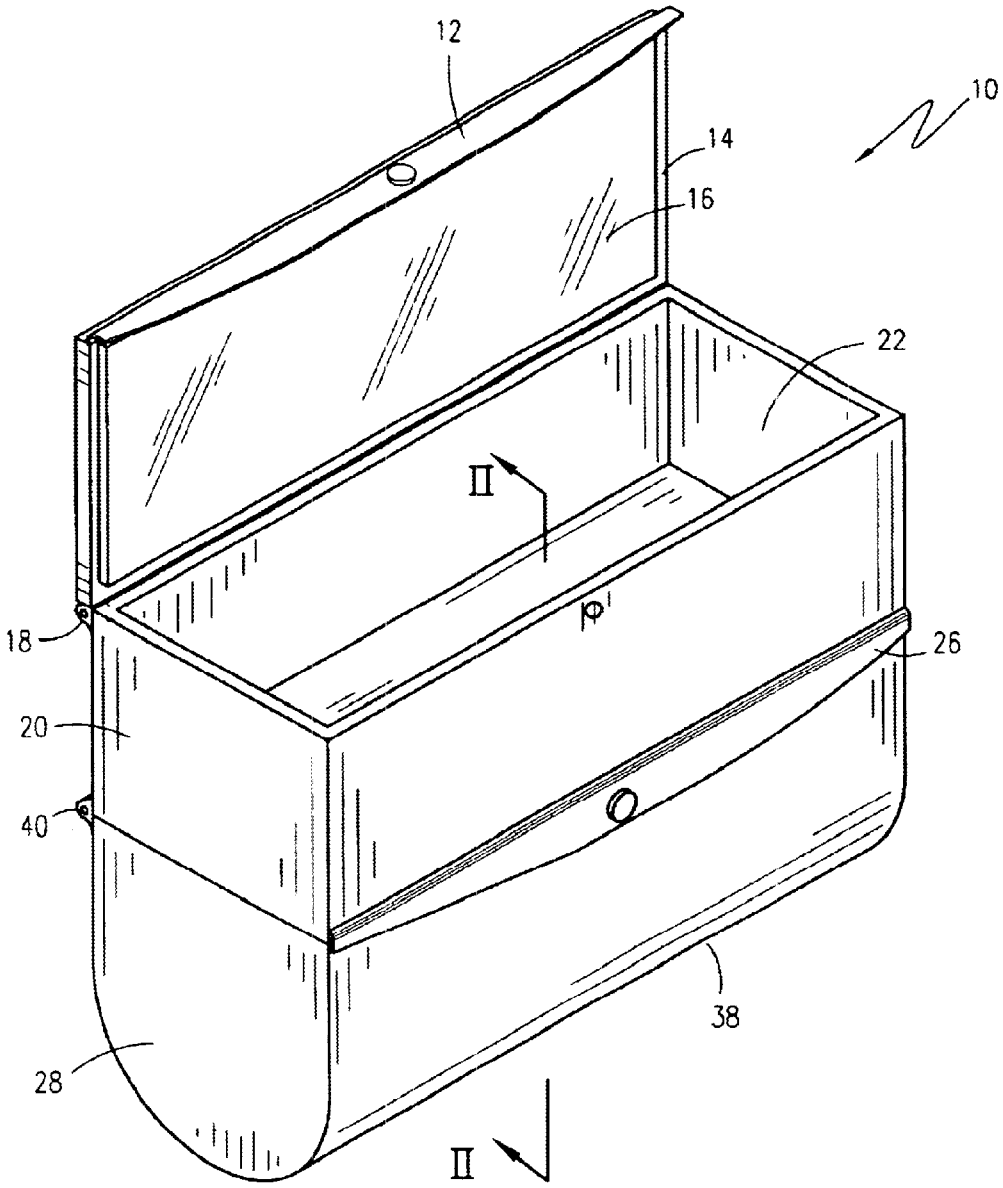
FIG. 1 is an exploded perspective view of a cosmetic storage and dispensing device with the invention viewed from the right front.

Referring now to FIG. 1 through FIG. 4, a cosmetic storage and dispensing device 10 is shown, according to the present invention, comprising an upper storage compartment 20, having four panels arranged perpendicularly to one another and a flat bottomed support panel 24 forming an upper storage compartment area 22, and further comprising a lower storage compartment 28, having four panels arranged perpendicularly to one another and a rounded bottom panel 38 forming a lower storage compartment area 32.

Figure 2:
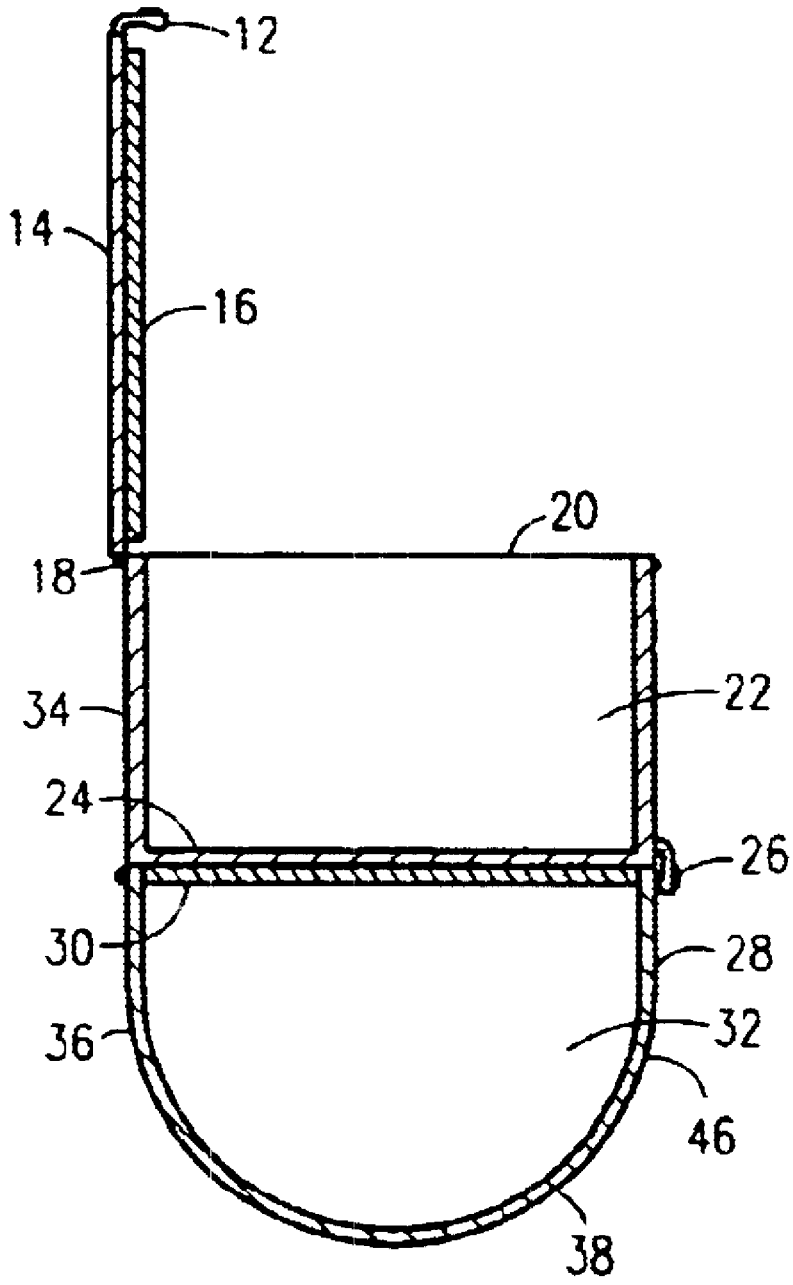

Referring particularly to FIG. 1 and FIG. 2, the apparatus is illustrated with the upper storage compartment 20 in an open position. The upper storage compartment 20 is capped by an upper reflective surface support means 14 pivotally attached to the upper back panel 34 of the upper storage compartment by a hinging means 18 and attaches to the front panel by an upper compartment closure means 12 to allow the user to open, close and access the upper storage compartment 20 and upper storage compartment area 22. An upper reflective surface 16 is adhesively or appropriately affixed to the reflective surface support means 14 so as to provide a means for cosmetic application and removal. The upper reflective surface support means 14 is adjustable to allow user to position the upper reflective surface 16 in an optimal position for viewing the desired object.

The upper storage compartment 20 is capable of storing a plurality of individual tissues or a pre-packaged tissue box that may be inserted into the upper storage compartment 20 and the upper storage compartment area 22. Though the upper storage compartment 20 is not limited to tissue storage, the combination of the upper reflective surface 16 and tissues from the upper storage compartment 20 allows the user to efficiently apply or remove cosmetics or other debris.

The lower storage compartment 28 is capped by the upper storage compartment 20. The upper storage compartment 20 is pivotally attached to the lower back panel 36 of the lower storage compartment.28 by a hinging means 40 and attaches to the front panel 46 of the lower storage compartment 28 by a lower compartment closure means 26 to allow the user to open, close and access the lower storage compartment 28 and the lower storage compartment area 32. A lower reflective surface 30 is adhesively or appropriately affixed to the lower reflective support means 24 so as to provide an additional means for cosmetic application or removal.

Figure 3:
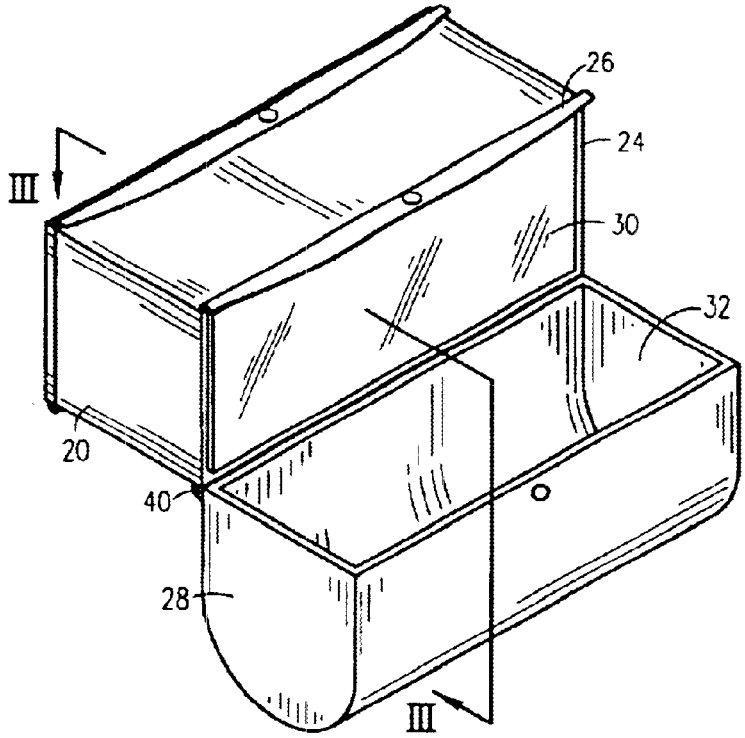
FIG. 3 is an exploded perspective view of the apparatus shown in FIG. 1 in which the upper storage compartment is closed and the lower storage compartment is flipped open, with the invention viewed from the right front.
Figure 4:
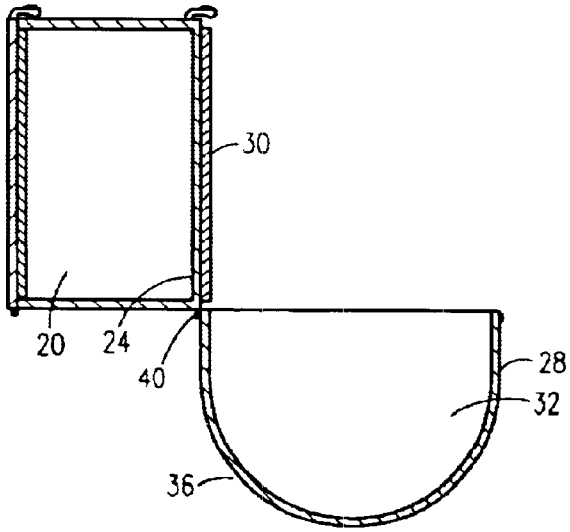
FIG. 4 is a cross-sectional view of the apparatus shown in FIG. 3 taken through line 3—3 and with the invention viewed from the right side.

Referring particularly to FIG. 3 and FIG. 4, the lower storage compartment 28, with a rounded bottom panel 38, is capable of storing a plurality of lipsticks and other cosmetic utensils. The combination of a lower reflective surface 30 and the lower storage compartment 28 allows the user to apply lipstick without having to close the lower storage compartment 28 to access the upper reflective surface 16. This arrangement has the advantage of avoiding the necessity of switching from the lower storage compartment 28 and the upper reflective surface 16.

Figure 5:
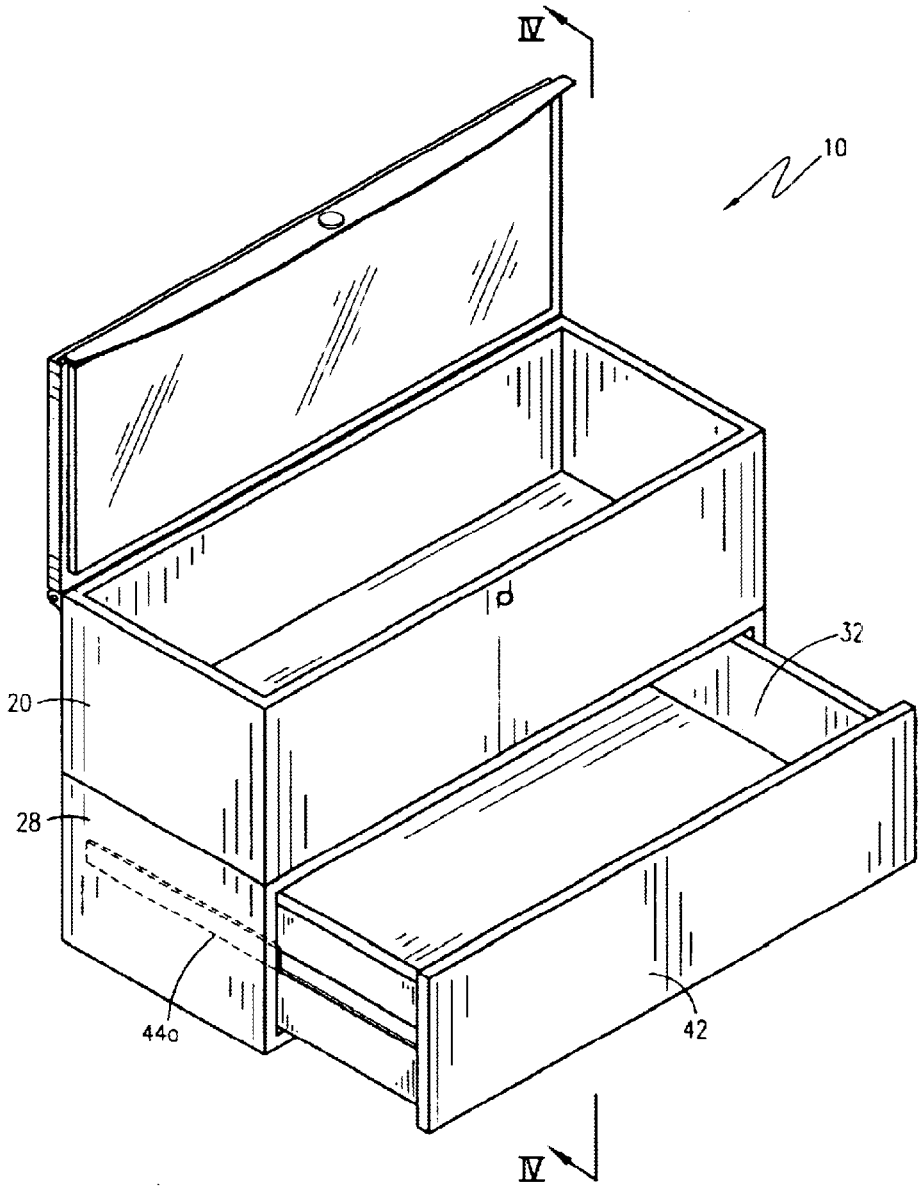
FIG. 5 is an exploded perspective view of an alternative embodiment of the invention in which the slidable lower storage compartment drawer is pulled out and with the invention viewed from the right front.
Figure 6:
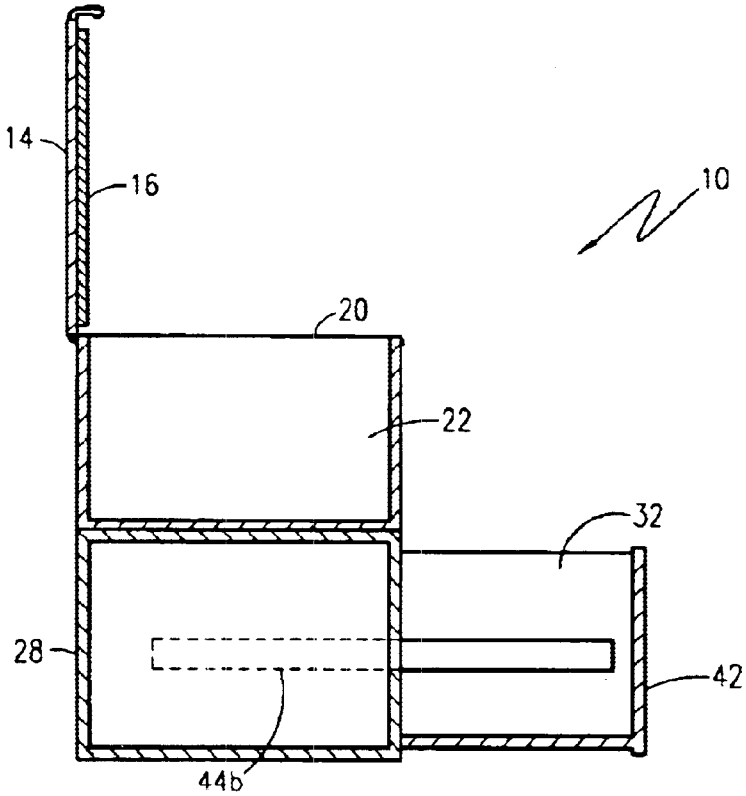
FIG. 6 is a cross-sectional view of the apparatus shown in FIG. 5 taken through line 5—5 and with the invention viewed from the left side.

FIG. 5 and FIG. 6 illustrates an alternative embodiment of a cosmetic storage and dispensing device 10 in accordance with the invention shown. This embodiment provides a lower storage compartment drawer 42 that is slidably attached to a pair of guide members 44a and 44b, in which the guide members are positioned opposite one another along the inner side panels of the lower storage compartment 28. This arrangement creates a lower storage compartment 28 that acts as a sliding drawer instead of the flip-top arrangement previously described in FIG. 1 through FIG. 4.

2. Operation of the Preferred Embodiment

To use the present invention, in accordance with a preferred embodiment of the present invention, as shown in FIG. 1, a user opens either the upper storage compartment 20 by the upper compartment closure means 12, or the lower storage compartment 28 by the lower compartment closure means 26, thus exposing the respective storage compartment area and its contents. The user then grasps the desired contents from the storage area compartment and adjusts the respective reflective surface to visualize the desired area. After the cosmetic is applied or removed, the storage contents are returned to the storage compartment area, and the respective compartment closure means is used to secure the contents neatly in the cosmetic storage and dispensing device.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A hand held cosmetic storage and dispensing device comprising:

an upper storage compartment having four panels arranged perpendicularly to one another and a flat bottomed support panel forming an upper storage compartment area, said upper storage compartment area capped by an upper reflective surface support means pivotally attached to said upper back panel of said upper storage compartment, said upper reflective surface support means supporting an upper reflective surface for applying and removing cosmetics; and a lower storage compartment having four panels arranged perpendicularly to one another and a rounded bottom panel forming a lower storage compartment area said rounded bottom panel provided for ergonomic placement in a user's palm and providing comfort thereto; wherein said lower storage compartment is capped by said upper storage compartment.

2. The hand held cosmetic storage and dispensing device of claim 1, wherein said back panel of said upper storage compartment attaches to said front panel by an upper compartment closure means to allow the user to open, close and access the upper storage compartment and upper storage compartment area.

3. The hand held cosmetic storage and dispensing device of claim 1, wherein said upper reflective surface support means is adjustable to allow a user to position said upper reflective surface means in an optimal position for viewing the desired object.

4. The hand held cosmetic storage and dispensing device of claim 1, wherein said upper storage compartment further comprises a pre-packaged tissue box.

5. The hand held cosmetic storage and dispensing device of claim 1, wherein said upper storage compartment is pivotally attached to said lower back panel of said lower storage compartment by a hinging means.

6. The hand held cosmetic storage and dispensing device of claim 5, wherein said upper storage compartment attaches to said front panel of said lower storage compartment by a lower compartment closure means to allow the user to open, close and access said lower storage compartment.

7. The hand held cosmetic storage and dispensing device of claim 5, further comprising a lower reflective surface affixed to said lower reflective support means so as to provide an additional means for cosmetic application or removal.

* * * * *